US010325697B2

(12) United States Patent
Shenouda

(10) Patent No.: US 10,325,697 B2
(45) Date of Patent: Jun. 18, 2019

(54) MULTI-PHASE CABLE

(71) Applicant: PRATT & WHITNEY CANADA CORP., Longueuil (CA)

(72) Inventor: Antwan Shenouda, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 15/978,666

(22) Filed: May 14, 2018

(65) Prior Publication Data

US 2018/0261357 A1 Sep. 13, 2018

Related U.S. Application Data

(62) Division of application No. 13/685,847, filed on Nov. 27, 2012, now Pat. No. 9,991,029.

(51) Int. Cl.
*H01B 7/30* (2006.01)
*H01B 7/08* (2006.01)
*H01B 7/42* (2006.01)

(52) U.S. Cl.
CPC ..... *H01B 7/30* (2013.01); *H01B 7/08* (2013.01); *H01B 7/421* (2013.01)

(58) Field of Classification Search
USPC ..... 174/115
See application file for complete search history.

(56) References Cited

U.S. PATENT DOCUMENTS 1,977,787 A * 10/1934 Wodtke ..... H01B 9/00 174/115
3,448,204 A * 6/1969 Perrone ..... H01B 7/08 174/115
3,621,118 A * 11/1971 Bunish ..... H01B 7/08 174/115
3,720,778 A * 3/1973 Woertz ..... H01R 4/2483 174/117 F
3,828,120 A * 8/1974 Hansen ..... H01B 7/041 174/115
4,023,887 A * 5/1977 Speers ..... G02B 6/3504 250/227.28
4,095,042 A * 6/1978 Ross ..... H01B 7/083 174/117 F (Continued)

OTHER PUBLICATIONS

United States Patent and Trademark Office, Office Action dated Apr. 23, 2014 re: U.S. Appl. No. 13/685,847.

(Continued)

*Primary Examiner* — William H. Mayo, III
*Assistant Examiner* — Krystal Robinson
(74) *Attorney, Agent, or Firm* — Norton Rose Fulbright Canada LLP

(57) ABSTRACT

A multi-phase cable, the cable including a plurality of conductors for conducting currents of two or more different phases, each phase being associated with one or more conductors and each conductor being associated with one respective phase. Each conductor has a cross-section with at least one dimension that is sized to decrease a skin effect of the conductor at a maximum or nominal operation frequency of the conductor. The conductors are arranged to permit free air cooling of the cable on at least two sides of each conductor, and such that each conductor of a given phase has, as immediate neighbors, only conductors of one or more different phases.

6 Claims, 3 Drawing Sheets

(56) References Cited

U.S. PATENT DOCUMENTS

| | | | | |
|---|---|---|---|---|
| 4,281,212 | A | 7/1981 | Bogese, II | |
| 4,652,772 | A | 3/1987 | Shephard | |
| 4,783,579 | A * | 11/1988 | Brandolf | B29C 47/0019 156/55 |
| 4,835,650 | A | 5/1989 | Epstein | |
| 4,857,675 | A * | 8/1989 | Marancik | H01F 6/06 174/15.4 |
| 5,053,583 | A * | 10/1991 | Miller | H01B 7/0892 174/115 |
| 7,554,780 | B2 * | 6/2009 | Wada | H02M 1/126 318/729 |
| 7,807,927 | B2 * | 10/2010 | Yeh | H01B 7/0838 174/110 R |
| 8,987,599 | B2 * | 3/2015 | Reuss | H02G 11/006 174/113 R |
| 9,391,380 | B2 * | 7/2016 | Little | H01L 31/05 |
| 2003/0214196 | A1 | 11/2003 | Cai et al. | |
| 2008/0173464 | A1 * | 7/2008 | Nair | H01B 7/0876 174/117 FF |
| 2008/0179969 | A1 | 7/2008 | Dooley et al. | |
| 2011/0006055 | A1 * | 1/2011 | Diehl | E21B 36/04 219/600 |
| 2013/0225005 | A1 * | 8/2013 | Fornage | H01R 12/613 439/658 |
| 2014/0144671 | A1 * | 5/2014 | Shenouda | H01B 7/30 174/115 |
| 2015/0300534 | A1 * | 10/2015 | Leininger | B60L 5/005 248/49 |

OTHER PUBLICATIONS

Norton Rose Fulbright Canada LLP, Response to Office Action dated Apr. 23, 2014 re: U.S. Appl. No. 13/685,847.
United States Patent and Trademark Office, Office Action dated Nov. 6, 2014 re: U.S. Appl. No. 13/685,847.
United States Patent and Trademark Office, Advisory Action dated Mar. 25, 2015 re: U.S. Appl. No. 13/685,847.
Norton Rose Fulbright Canada LLP, Response to Office Action dated Nov. 6, 2014 re: U.S. Appl. No. 13/685,847.
Norton Rose Fulbright Canada LLP, Further Response to Office Action dated Nov. 6, 2014 filed on Apr. 2, 2015 re: U.S. Appl. No. 13/685,847.
United States Patent and Trademark Office, Office Action dated Jun. 19, 2015 re: U.S. Appl. No. 13/685,847.
Norton Rose Fulbright Canada LLP, Response to Office Action dated Jun. 19, 2015 re: U.S. Appl. No. 13/685,847.
United States Patent and Trademark Office, Office Action dated Feb. 2, 2016 re: U.S. Appl. No. 13/685,847.
United States Patent and Trademark Office, Applicant-Initiated Interview Summary dated Apr. 18, 2016 re: U.S. Appl. No. 13/685,847.
Norton Rose Fulbright Canada LLP, Response to Office Action dated Feb. 2, 2016 re: U.S. Appl. No. 13/685,847.
Norton Rose Fulbright Canada LLP, Supplementary Response to Office Action and Summary of Interview filed on Apr. 26, 2016 re: U.S. Appl. No. 13/685,847.
United States Patent and Trademark Office, Office Action dated Nov. 18, 2016 re: U.S. Appl. No. 13/685,847.
Norton Rose Fulbright Canada LLP, Response to Office Action dated Nov. 18, 2016 re: U.S. Appl. No. 13/685,847.

* cited by examiner

FIG. 3
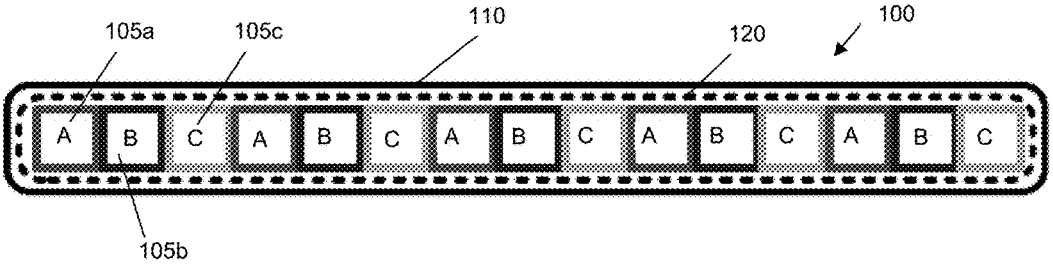
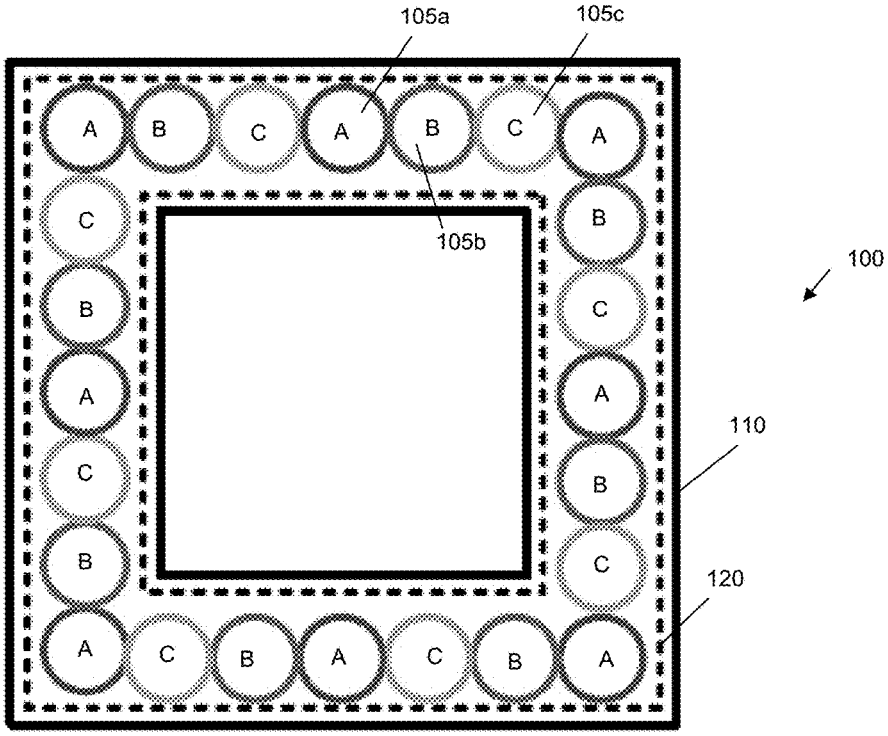
FIG. 4

MULTI-PHASE CABLE

CROSS-REFERENCE TO RELATED APPLICATION(S) AND CLAIM OF PRIORITY

The present application is a divisional of U.S. patent application Ser. No. 13/685,847 filed on Nov. 27, 2012, the entire contents of which are hereby incorporated by reference.

TECHNICAL FIELD

The disclosure relates generally to electrical cables, particularly multi-phase cables.

BACKGROUND OF THE ART

Wire current rating typically takes into account several factors including: free air rating, altitude derating and bundle derating. Wires or conductors carrying alternating current may also take into account skin and proximity effects derating.

Free air rating of a wire may be related to the surface area of the wire and not necessarily the cross-sectional area. Thus, several wires having the an equivalent cross-sectional area as a larger wire may together have a higher combined free air rating than the larger wire, because their total surface is larger. However, as the number of wires in a bundle (e.g., in a multi-wire cable) increases, the cable rating may decrease. This may be because convection with free air may be only accomplished by the wires on the outer perimeter of the bundle. Thus, a cable may exhibit bundle derating, as the number of conductors in a bundle increases. Cable rating may also decrease with increasing altitude, as free air density decreases and convection cooling decreases.

For wires carrying alternating current, skin depth is inversely related to square root of current frequency. Skin depth refers to the tendency of alternating electric current to distribute itself with greater current density near the surface of the conductor and decreasing in density with increasing depth. As the frequency increases, the skin depth decreases. This phenomenon is known as the "skin effect". At high enough frequencies, the interior of the conductor does not carry much current, which may result in relatively high ohmic losses.

Alternating currents of the same phase and frequency in adjacent insulated conductors arranged in a bundle also have an electromagnetic effect on each other. This effect, referred to as the "proximity effect", tends to force the currents to flow on the surfaces of the outside conductors.

The combination of skin and proximity effects may reduce the usefulness of a cable to carry high-frequency currents at high amperage.

SUMMARY

In some example aspects, the present disclosure provides a multi-phase cable, the cable comprising: a plurality of conductors for conducting currents of two or more different phases, each phase being associated with one or more conductors and each conductor being associated with one respective phase; each conductor having a cross-section with at least one dimension that is sized to decrease a skin effect of the conductor at a maximum or nominal operation frequency of the conductor; wherein the conductors are arranged to permit free air cooling of the cable on at least two sides of each conductor, and such that each conductor of a given phase has, as immediate neighbors, only conductors of one or more different phases.

Further details of these and other aspects of the subject matter of this application will be apparent from the detailed description and drawings included below.

DESCRIPTION OF THE DRAWINGS

Reference is now made to the accompanying drawings, in which:

FIG. 3 is a schematic diagram showing a cross-section of another example multi-phase cable, in accordance with the present disclosure;

FIG. 4 is a schematic diagram showing a cross-section of another example multi-phase cable, in accordance with the present disclosure.

DETAILED DESCRIPTION

Aspects of various example embodiments are described through reference to the drawings.

The present disclosure may help to increase the cable rating of multi-phase current-carrying cables. The present disclosure may also help to decrease undesirable effects caused by bundling wires together and/or by skin and/or proximity effects.

Figure 1A:
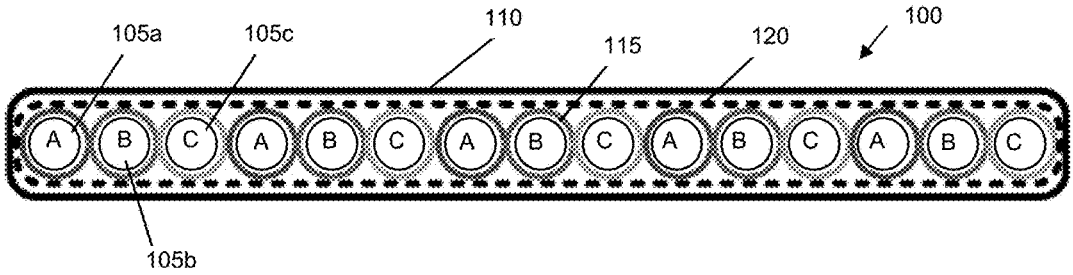
FIG. 1A is a schematic diagram showing a cross-section of an example multi-phase cable, in accordance with the present disclosure.
Figure 1B:
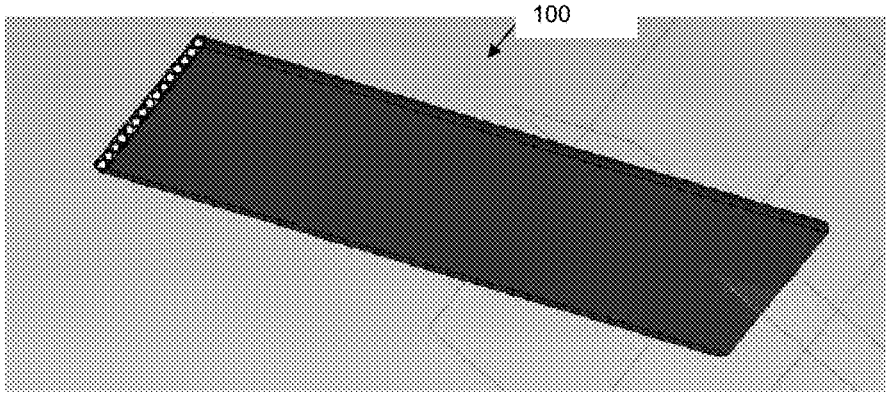
FIG. 1B is an isometric view of the multi-phase cable of FIG. 1A.

Reference is made to FIGS. 1A and 1B, showing an example multi-phase cable 100. In this example, the cable 100 may include conductors 105*a*, 105*b*, 105*c*, each being associated with respective current phases A, B, C, as indicated. The cable 100 may also include a cable insulator 110 surrounding the conductors 105*a*, 105*b*, 105*c* and along the length of the cable 100. There may also be conductor insulators 115 surrounding each of the conductors 105*a*, 105*b*, 105*c* along their respective lengths. There may be two or more current phases conducted in the cable 100. In this example, there are three phases A, B, C, although the cable 100 may conduct more or less number of phases (e.g., six-phases) by increasing or decreasing the number of conductors 105*a*, 105*b*, 105*c* accordingly, for example. There may be two or more conductors 105*a*, 105*b*, 105*c* conducting each of the different phases, although in other examples there may be one of each conductor 105*a*, 105*b*, 105*c* for conducting each of the different phases. In this example, there are five conductors 105*a*, 105*b*, 105*c* for each of the phases A, B, C, although there may be more or less number of conductors 105*a*, 105*b*, 105*c* for each phase. In some examples, the cable 100 may optionally include a shield 120.

The number of conductors 105*a*, 105*b*, 105*c* may be unevenly distributed among different phases. For example, there may be a greater number of conductors 105*a*, 105*b*, 105*c* of one given phase than another phase.

The use of more than one conductor 105*a*, 105*b*, 105*c* for a given phase may be useful where the diameter of each conductor 105*a*, 105*b*, 105*c* is inversely related to the frequency of the conducted current, resulting in smaller conductors for higher frequencies. In such a case, the current of a given phase may be divided among multiple conductors 105*a*, 105*b*, 105*c* to carry the full load. Such an arrangement may be useful where the conductors 105*a*, 105*b*, 105*c* may extend for a significant length parallel to each other in the cable 100 and where the skin effect and proximity effect may otherwise be significant.

Each conductor 105*a*, 105*b*, 105*c* may be configured to have a cross-section with at least one dimension that is sized to decrease the skin effect at the maximum or nominal operation frequency of the conductor 105*a*, 105*b*, 105*c*. Such a configuration may help to reduce ohmic losses arising from the skin effect by helping to ensure that current flows relatively uniformly throughout substantially the entire cross-section of the conductor 105*a*, 105*b*, 105*c*.

For example, at least one dimension may be sized to be equal to or less than six times the skin depth of the conductor 105*a*, 105*b*, 105*c* at the maximum or nominal operation frequency, which may be sufficient to achieve an ohmic loss ratio that is less than or equal to two. This may substantially decrease the skin effect in the conductor 105*a*, 105*b*, 105*c*, sufficient to cause a substantially performance improvement.

Figure 5:
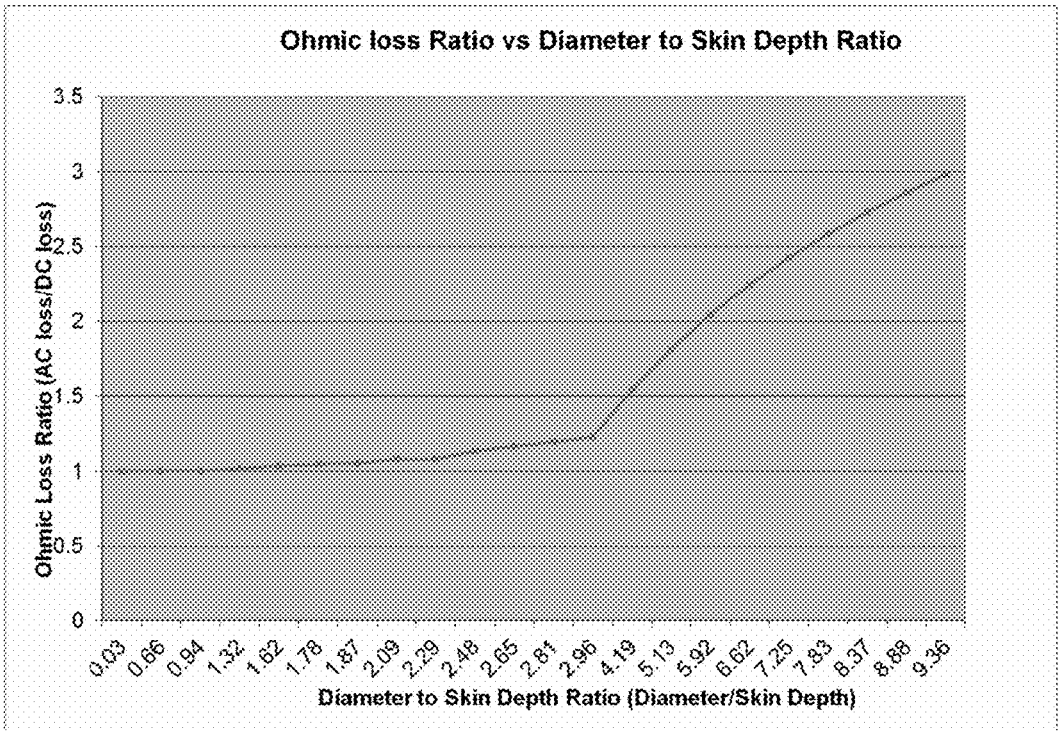
FIG. 5 is a chart illustrating an example of ohmic loss ratio at different skin depths, for a 15×14 gauge wire cable at a given current.

FIG. 5 illustrates an example of how the ohmic loss ratio for a 15×14 gauge wire cable conducting a given current is affected by the cross-sectional diameter of the conductors. As shown in this chart, as the cross-sectional diameter increases relative to the skin depth, the ohmic loss increases. At a diameter to skin depth ratio of about six, the ohmic loss ratio is about two. An ohmic loss ratio of about two may be acceptable, and may be a substantially decrease in the skin effect. A diameter to skin depth ratio of about two results in an ohmic loss ratio of about one (i.e., almost no ohmic loss), which may be particularly useful.

In the example of FIGS. 1A and 1B, the cross-section of each of the conductors 105*a*, 105*b*, 105*c* may have at least one dimension less than or equal to two times the skin depth of the respective conductor 105*a*, 105*b*, 105*c* at the maximum operation frequency of the conductor 105*a*, 105*b*, 105*c*.

For example, where the cross-section of the conductor 105*a*, 105*b*, 105*c* is substantially circular, the diameter of the conductor 105*a*, 105*b*, 105*c* may be selected to be less than or equal to twice the skin depth at the maximum frequency of operation. In another example, where the cross-section of the conductor 105*a*, 105*b*, 105*c* is substantially rectangular, the smaller dimension (i.e., width) of the rectangular cross-section may be selected to be less than or equal to twice the skin depth at the maximum frequency of operation.

In some examples, all dimensions of the cross-section of the conductor 105*a*, 105*b*, 105*c* may be sized to decrease the skin effect. For example, all dimensions of the cross-section of the conductor 105*a*, 105*b*, 105*c* may be sized to be less than or equal to two times the skin depth of the conductor 105*a*, 105*b*, 105*c* at the maximum or nominal operation frequency, such as a cross-section that is substantially square, with height and widths both being less than or equal to two times the skin depth of the conductor 105*a*, 105*b*, 105*c* at the maximum or nominal operation frequency.

In some examples, the cable 100 may be rated to operate at frequencies in the range of 60 Hz and lower to 1 MHz and possibly higher. For example, the cable 100 may be rated to operate at frequencies for which Litz wire may be used (e.g., at least up to 500 kHz).

In some examples, the conductors 105*a*, 105*b*, 105*c* may be rated for currents up to about 3.6 kHz which typically results in a skin depth of about 0.056 in. Thus, a conductor 105*a*, 105*b*, 105*c* having a substantially circular cross-section may be configured to have a cross-sectional diameter of about 0.112 in or less. For example, the conductor 105*a*, 105*b*, 105*c* may be a 14 gauge wire, having a diameter of about 0.076 in. Similarly, a conductor 105*a*, 105*b*, 105*c* having a substantially rectangular cross-section may be configure to have a cross-sectional width of 0.112 in or less.

The cable 100 may be sized according to the application and to accommodate the conductors 105*a*, 105*b*, 105*c*. For example, where the conductors 105*a*, 105*b*, 105*c* are spaced farther apart from each other (e.g., to allow for better convection and cooling), the cable 100 may be wider.

Other cross-section geometries may be suitable for the conductors 105*a*, 105*b*, 105*c* including, for example, square, hexagonal, or any suitable regular or irregular geometries.

The size and/or shapes of the cross-section of individual conductors 105*a*, 105*b*, 105*c* may be modified as appropriate to accommodate higher or lower frequency current (e.g., at lower frequencies, skin depth increases and the dimensions of the cross-section of individual conductors may be modified accordingly). Individual conductors 105*a*, 105*b*, 105*c* may have similar or dissimilar cross-sectional shapes and/or sizes, as appropriate.

The conductors 105*a*, 105*b*, 105*c* may be arranged in a single layer in the cable 100. That is, the conductors 105*a*, 105*b*, 105*c* may be arranged side-by-side but not overlapping, such that the cable 100 may be substantially planar. This may be similar to a single-row ribbon cable, which have not been conventionally used for power transmission, in particular for high-frequency multi-phase current.

Such a configuration may help to increase convection, since each conductor 105*a*, 105*b*, 105*c* may be cooled by free air from at least two directions. This may help to improve the bundle derating factor. This substantially planar arrangement of conductors 105*a*, 105*b*, 105*c* may improve the current rating relative to if the same conductors 105*a*, 105*b*, 105*c* were arranged in a bundle.

For example, a single conductor in free air would be cooled all about its perimeter (equal to about $2\pi rl$, where r is the radius of a the circular cross-section of the conductor and l is the length of the conductor). A single conductor located away from the perimeter of a bundle, which is the case for most conductors in a bundle cable, would experience no free air cooling (equal to about 0). A single conductor 105*a*, 105*b*, 105*c* in the cable 100 would have free air cooling from at least two sides of the cable (equal to about 4rl). The ratio of cooling, compared to free air cooling of a single conductor, is thus about 0 for a conductor in a bundle cable, and about $4r/2\pi r=0.6366$ in the arrangement of the disclosed cable 100.

Where one current phase is conducted by two or more conductors 105*a*, 105*b*, 105*c* the conductors 105*a*, 105*b*, 105*c* may be arranged such that each conductor 105*a*, 105*b*, 105*c* of a given phase has, as immediate neighbors, only conductors 105*a*, 105*b*, 105*c* of one or more different phases. For example, a conductor 105*a*, conducting current at phase A may have as immediate neighbors only conductors 105*b*, 105*c* conducting currents at phase B and C. By having no two conductors 105*a*, 105*b*, 105*c* of the same phase directly adjacent to one another, this may help to reduce the proximity effect. This may help to further reduce ohmic losses, which may allow the conductors 105*a*, 105*b*, 105*c* (and thus the cable 100) to operate at higher currents. Because the conductors 105*a*, 105*b*, 105*c* are arranged in a single layer side-by-side arrangement, each conductor 105*a*, 105*b*, 105*c* may have at most two immediate neighbors. This lower number of immediate neighbors may help to reduce skin and/or proximity effects.

Figure 2:
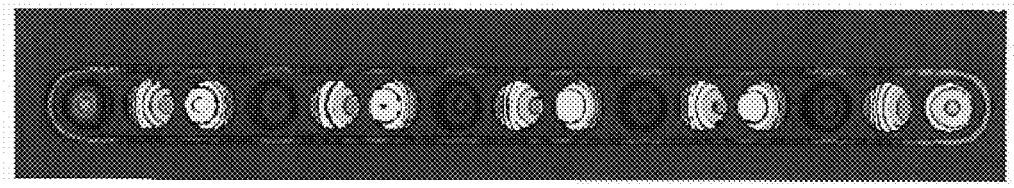
FIG. 2 illustrates current distribution at a given point in time for the example cable of FIG. 1A.

FIG. 2 illustrates current density in the example cable of FIGS. 1A and 1B at an instant in time. In FIG. 2, higher current density is indicated by a brighter (red) gradient, and lower current density is indicated by a darker (blue) gradient. In the example shown, conductors 105*a* conducting phase A current have lower current density than conductors 105*b*, 105*c* conducting phases B and C current. However, all conductors 105*a*, 105*b*, 105*c* in the cable 100 participate in conducting current. In contrast, for a cable having a bundle arrangement of conductors, conductors in the center of the cable may have little or no conduction of current.

FIG. 3 shows another example embodiment of the cable 100, in which the conductors 105*a*, 105*b*, 105*c* have non-circular (in this example, square) cross-sections. The cable 100 in FIG. 3 may include a cable insulator 110, conductor insulators 115 and/or a shield 120, similar to the cable 100 of FIGS. 1A AND 1B.

FIG. 4 shows another example embodiment of the cable 100, in which the cable 100 is configured as a hollow tube, with the conductors 105*a*, 105*b*, 105*c* arranged along the circumference of the tube. The cable 100 in FIG. 4 may include a cable insulator 110, conductor insulators 115 and/or a shield 120, similar to the cable 100 of FIGS. 1A AND 1B. Although the conductors 105*a*, 105*b*, 105*c* in FIG. 4 are not arranged in a planar layer, as in FIGS. 1 and 3, the conductors 105*a*, 105*b*, 105*c* in FIG. 4 are nonetheless still in a single layer within the cable. That is, each conductor 105*a*, 105*b*, 105*c* is exposed to free air cooling from at least two sides. In the example of FIG. 4, because the cable 100 is configured as a rectangular tube, the conductors 105*a*, 105*b*, 105*c* situated at the corner locations may be exposed to free air cooling from two adjacent sides, whereas the other conductors may be exposed to free air cooling from two opposing sides.

The cable 100 may be made of any suitable materials. For example, the conductors 105*a*, 105*b*, 105*c* may be made of any suitable conductive material including, for example, copper. The cable and conductor insulators 110, 115 may be made of any suitable insulating material including. The material for the conductors 105*a*, 105*b*, 105*c* and the cable and conductor insulators 110, 115 may be selected to accommodate high frequency (e.g., 400 Hz or higher) and/or high temperature (e.g., up to 200° C. or higher) use. The thickness of the cable and conductor insulators 110, 115 may also be selected to suit the application. For example, for high temperature (e.g., up to 200° C. or higher) and/or high voltage use, the conductor insulators 115 may be about 0.010 in thick.

The combination of the disclosed conductor geometries and arrangements may help to increase the rating of a multiphase cable with less conductive material. This improvement in rating may translate into size, weight (e.g., up to 50% reduction or more) and/or cost reduction of multi-phase cables and connectors.

For example, a "derating factor" for a cable may be defined as the direct current (DC) ohmic loss of the cable divided by the alternating current (AC) ohmic loss of the cable at its highest rated frequency. A higher derating factor may indicate better rating for a cable. For example, a bundle of 54 conductors is expected to have a derating factor of about 0.26. Example calculations and simulations have shown that a bundle cable of 54 conductors as arranged in U.S. patent application publication no. 2008/0179969, for example, may be expected to have a derating factor of about 0.564. In comparison, calculations and simulations have shown that the example cable of FIGS. 1A AND 1B may be expected to have a derating factor of about 0.95.

The present disclosure may allow for reduction in alternating current ohmic losses while keeping the weight and/or size of the cable relatively low. In weight sensitive applications, such airborne equipment, this may be useful. Lower weight cables may also allow for more packaging and/or transportation options.

The present disclosure may also provide a multi-phase cable that is relatively simple to design and/or manufacturing. The disclosed cable may be manufactured using suitable wire and ribbon manufacturing techniques (e.g., by a ribbon cable manufacturer) that may not need expensive weaving machines. This may translate into reduced cost of the cables.

A high-frequency multi-phase ribbon cable, in an example of the present disclosure, may be rated to more than 90% of the direct current rating of a ribbon cable having similar dimensions and configuration.

A multi-phase cable incorporating this arrangement of conductors may be useful in various applications to conduct high frequency multi-phase currents. For example, such a cable may be used in engines, high speed motors and high speed generators. The present disclosure may be useful in any application where multi-phase current, including high-frequency current, is conducted, or any application where skin depth may be a concern. For example, the present disclosure may be useful for high-frequency transmission. The present disclosure may also be useful in low-frequency (e.g., 60 Hz or lower) applications.

The present disclosure may differ from other multi-phase cables in various ways. For example, typical non-insulated stranded cables may ignore the skin and proximity effects and may deal with the excess heat generated by either cooling the conductors or letting the cables run hot. In both cases, there may be significant wasted energy, and in the second case, the life of the insulation of the cable may be reduced by the heat.

In some other multi-phase cables, the skin and proximity effects may be dealt with by making the conductors larger and hollow, with the conducting material only as thick as the skin depth. However, the conductors tend to have much larger diameters and are much bulkier, which may limit the types of application for the cable.

Another multi-phase cable is a Litz wire. Litz wire may aim to reduce the impact of the skin and proximity effects by weaving precise patterns with the insulated conductive strands in such a way that each strand resides for small intervals on the outside of the bundle and for small intervals on the inside of the bundle. This may allow the interior of the bundle to contribute to the conduction, such that each strand may have the same average resistance as all the others. Disadvantages of Litz wire include the high cost, the complexity of the weaving procedure, and the added weight and length of conductors due to the weaving pattern.

The above description is meant to be exemplary only, and one skilled in the art will recognize that changes may be made to the embodiments described without departing from the scope of the invention disclosed. For example, the conductors may have any suitable dimensions and/or cross-sectional geometries, and may be arranged in any suitable configuration. Any suitable conductive material may be used for the conductors, and any suitable insulating material may be used for the insulators. The cable may be configured to accommodate any number of phases. Still other modifications which fall within the scope of the present disclosure will be apparent to those skilled in the art, in light of a review of this disclosure, and such modifications are intended to fall within the appended claims.

The invention claimed is:

1. A method for transmitting multi-phase power using a cable comprising a plurality of conductors arranged in a single layer to permit free air cooling of the cable on two sides of each conductor and each conductor having a cross-section sized based on an operation frequency of an alternating electrical current of each phase to decrease a skin effect in the conductor, the method comprising:

conducting alternating electrical current of a first phase through a first of the conductors; and conducting alternating electrical current of a second phase different from the first phase through a second of the conductors where the second conductor is directly adjacent to the first conductor and electrically insulated from the first conductor, wherein a cross-section of the first conductor and a cross-section of the second conductor are sized to yield an ohmic loss ratio less than or equal to two.

2. The method as defined in claim 1, wherein the first conductor and the second conductor are unshielded from each other.

3. The method as defined in claim 1, comprising conducting alternating electrical current of a third phase different from the second phase through a third of the conductors where the third conductor is directly adjacent to the second conductor and electrically insulated from the second conductor.

4. The method as defined in claim 1, comprising: conducting alternating electrical current of the first phase through a first group of the conductors comprising the first conductor; and conducting alternating electrical current of the second phase different from the first phase through a second group of the conductors comprising the second conductor.

5. The method as defined in claim 1, wherein a cross-section dimension of the first conductor and a cross-section dimension of the second conductor are sized to be equal to or less than six times a skin depth of the respective first and second conductors at the respective operation frequencies.

6. The method as defined in claim 1, wherein a cross-section dimension of the first conductor and a cross-section dimension of the second conductor are sized to be equal to or less than two times a skin depth of the respective first and second conductors at the respective operation frequencies.

* * * * *